United States Patent [19]

Stewart

[11] Patent Number: 5,010,841

[45] Date of Patent: Apr. 30, 1991

[54] ROTATING SEALANT APPLICATOR

[75] Inventor: William R. Stewart, LaPalma, Calif.

[73] Assignee: McDonnell Douglas Corporation, Long Beach, Calif.

[21] Appl. No.: 355,674

[22] Filed: May 23, 1989

[51] Int. Cl.[5] ..... B05C 5/02

[52] U.S. Cl. ..... 118/711; 29/34 B; 118/113; 118/241; 118/244; 118/254; 118/258; 222/513; 222/515

[58] Field of Search ..... 118/710, 711, 113, 241, 118/244, 254, 258, 259, 317; 425/562, 564, 565, 566; 222/509, 513, 514, 515; 29/34 B, 458; 74/57, 89

[56] References Cited

U.S. PATENT DOCUMENTS

| | | | |
|---|---|---|---|
| 2,944,431 | 7/1960 | Dexter | 74/89 |
| 3,036,810 | 5/1962 | Conrad et al. | 74/57 |
| 3,332,108 | 7/1967 | Bustamante | 118/711 |
| 3,350,774 | 11/1967 | Bridges, Sr. | 29/458 |
| 3,904,718 | 9/1975 | Kuehn, Jr. | 118/254 |
| 4,135,476 | 1/1979 | Duryea | 118/259 |
| 4,144,625 | 3/1979 | Hogenhout | 118/254 |
| 4,429,658 | 2/1984 | Jones | 118/711 |
| 4,635,827 | 1/1987 | Roedig | 118/410 |
| 4,786,060 | 11/1988 | Davis | 118/711 |

FOREIGN PATENT DOCUMENTS

| | | | |
|---|---|---|---|
| 209395 | 5/1984 | German Democratic Rep. | 118/254 |
| 211287 | 7/1984 | German Democratic Rep. | 118/254 |
| 915586 | 1/1963 | United Kingdom | 222/513 |

*Primary Examiner*—James C. Housel

*Attorney, Agent, or Firm*—Ben J. Yorks; George W. Finch; John P. Scholl

[57] ABSTRACT

An apparatus and method for applying sealant to a countersunk fastener hole. The apparatus includes a sleeve, an adapter tube within the sleeve, a nozzle housing attached to the adapter tube, and a tip within the nozzle housing. A guide pin is attached to the adapter tube and follows an oblique slot in the sleeve. To operate, the sealant applicator is inserted into a countersunk fastener hole, engaging the tip with the countersink of the hole. The tip depresses into the nozzle housing, ejecting sealant onto the countersink. The adapter tube is pushed into the sleeve, moving the guide pin along the oblique slot in the sleeve. This guide pin movement rotates the adapter tube, nozzle housing and tip, causing the tip to uniformly spread the sealant around the countersink.

4 Claims, 2 Drawing Sheets

ROTATING SEALANT APPLICATOR

BACKGROUND OF THE INVENTION

The preventing airplane corrosion, there has developed a requirement to apply an anti-corrosive sealant between rivets and the rivet securing member, such as the skin of the plane. This can be achieved by injecting the sealant into the rivet holes and then inserting the rivets, a process that is presently performed by hand. Because thousands of rivets are inserted into an airplane wing, the aircraft industry is employing the use of automated rivet machines, with corresponding automated sealant applicators.

Most rivets have a tapered head which require a countersink in the rivet hole. To obtain a complete seal, it is necessary to have sealant cover the entire circumference of the countersink. Present applicators eject a ring of sealant "balls" that are spread around the countersink when the rivet is pressed into the hole. To insure complete coverage of the countersink, an excess amount of sealant is injected into the rivet hole. If too much sealant becomes entrapped between the countersink and the rivet, the sealant will exert a hydraulic pressure on the rivet, pushing the rivet out of the rivet hole. In addition, the excessive sealant squeezes onto the surface of the wing, requiring an additional step of removing the excess sealant, a time consuming process presently performed by hand. Thus there is a need for a sealant applicator to provide an exact amount of sealant that uniformly covers the circumference of a rivet hole.

Present nozzles include a spring return tip attached to the nozzle housing, where the amount of sealant ejected is adjusted by rotating the tip within the housing. Selfturning of the tip during an automated cycle of riveting, causes inconsistent ejections of sealant, resulting in rivets with excessive or inadequate amounts of sealant. It is therefore desirable to have a nozzle with means to prevent tip rotation within the housing, during sealant operations.

SUMMARY OF THE INVENTION

This invention is an apparatus and method for applying sealant to a countersunk fastener hole. The apparatus comprises a sleeve, an adapter tube within the sleeve, a nozzle housing attached to the adapter tube, and a tip within the nozzle housing. A guide pin is attached to the adapter tube and follows an oblique slot in the sleeve. To operate, the sealant applicator is inserted into a countersunk fastener hole, engaging the tip with the countersink of the hole. The tip depresses into the nozzle housing, ejecting sealant onto the countersink. The adapter tube slides into the sleeve, moving the guide pin along the oblique slot in the sleeve. This guide pin movement rotates the adapter tube, nozzle housing and tip, causing the tip to uniformly spread the sealant around the countersink. The uniform application of the sealant eliminates the need to eject excessive amounts of sealant, reducing clean up cost and hydraulic sealant pressure "push out".

Undesirable rotation of the tip within the nozzle housing, is prevented by attaching a collar with a tongue onto the nozzle housing. The tongue travels along a vertical groove in the tip, preventing rotational movement of the tip within the nozzle housing.

It is an object of this invention to provide a method of automatically applying sealant into a fastener hole.

It is an object of this invention to have uniform application of sealant throughout a fastener hole.

It is an object of this invention to apply nonexcessive amounts of sealant in a rivet hole.

It is an object of this invention to have a reliable, low cost sealant applicator that combines its rotational and translational movement.

It is an object of this invention to have a tip that does not rotate within a nozzle housing.

BRIEF DESCRIPTION OF THE DRAWINGS

The objectives and advantages of this invention will become more apparent to those skilled in the art after reviewing the following specification and drawings, wherein.

DETAILED DESCRIPTION OF THE INVENTION

Figure 1:
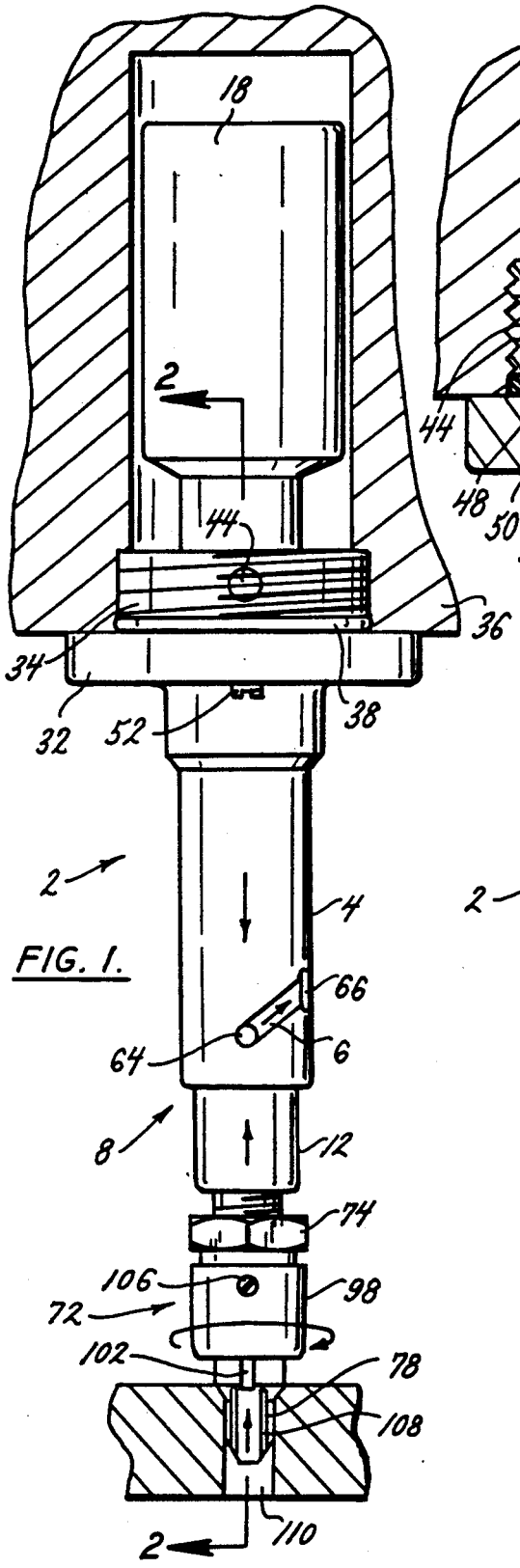
FIG. 1 is a rotating sealant applicator engaging a countersunk rivet hole.
Figure 2:
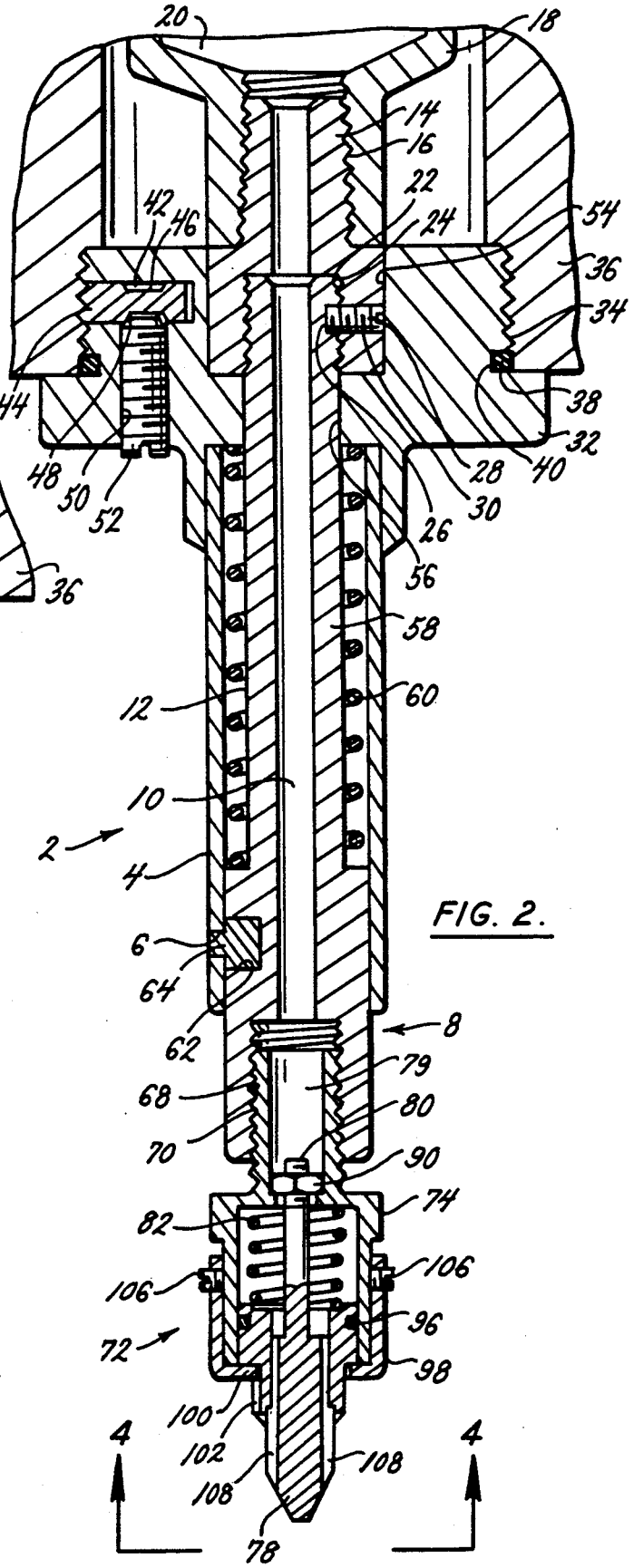
FIG. 2 is a cross-section of a rotating sealant applicator.

Referring to the drawings more particularly by reference numbers, a rotating sealant applicator assembly 2 is shown in FIG. 1 having a sleeve 4 with a slot 6 oblique to the bottom of the sleeve 4. Within and extending from the sleeve 4 is a dispenser tube 8 with a longitudinal channel 10, see FIG. 2. The dispenser tube 8 comprises an adapter tube 12 and sealant inlet cap 14. The sealant inlet cap 14 has an external thread 16 to provide means for attaching a sealant cartridge 18. The sealant cartridge 18 is a pressurized container full of sealant 20. The adaptor tube 12 and sealant inlet cap 14 have matching external 22 and internal threads 24 respectively, to allow the sealant inlet cap 14 to screw onto the adapter tube 12. The ability of the sealant inlet cap 14 to detachably connect to the adapter tube 12, allows the attachment of different sealant inlet caps 14, with a range of external thread 16 diameters to match various sealant cartridge 18. The adapter tube 12 may have a threaded aperture 26 that receives a set screw 28 inserted through a aperture 30 in the sealant inlet cap 14. Screwing the set screw 28 into the aperture 26 prevents the sealant inlet cap 14 from rotating and disengaging from the adapter tube 12.

A cylinder cap 32 is brazed to the sleeve 4. The cylinder cap 32 has an external thread 34 that threadedly connects the rotating sealant tip assembly 2 to the frame of an automatic riveting machine 36. The cylinder cap 32 has an external groove 38 that retains an O ring 40, which provides a seal between the automatic rivet machine 36 and the cylinder cap 32. The cylinder cap threads 34 have an aperture 42 which receives a lock pin 44. The lock pin 44 has a neck 46 with a 45° collar 48. The cylinder cap 32 has a threaded aperture 50 perpendicular to the cap threaded aperture 42, which receives a set screw 52. After the cylinder cap 32 has been screwed into the automatic rivet machine 36, the set screw 52 is rotated, engaging the screw 52 with the 45° collar 48 of the lock pin 44, pushing the lock pin 44 toward the automatic rivet machine 36, further securing the cylinder cap 32 to the rivet machine 36.

The cylinder cap 32 has a first 54 and second 56 bore which are slightly larger than the outside diameters of the sealant inlet cap 14 and adapter tube 12 respectively.

The adapter tube 12 and sealant inlet cap 14 sit in the second 56 and first 54 bores, whereby the cylinder cap 32 insures that the adapter tube 12 moves along the sleeve 4 in a linear manner.

The adapter tube 12 has a neck 58 with a diameter smaller than the inner diameter of the sleeve 4. A spring 60 fits around the neck 58 and is radially surrounded by the sleeve 4. The adapter tube 12 has an aperture 62 that receives the base of a guide pin 64. The guide pin 64 extends from the adapter tube 12 into the slot 6 of the sleeve 4. At the end of the slot 6 is an opening 66 that is larger than the base of the guide pin 64. To assemble the guide pin 64, the adapter tube 12 is pushed into the sleeve 4 until the adapter tube aperture 62 is aligned with the sleeve opening 66. The guide pin 64 is inserted into the aperture 62, the spring 62 returns the adapter tube 12, moving the guide pin 64 along the slot 6. The width of the slot 6 is smaller than the base of the guide pin 64, whereby the sleeve 4 retains the guide pin 64.

Figure 3:
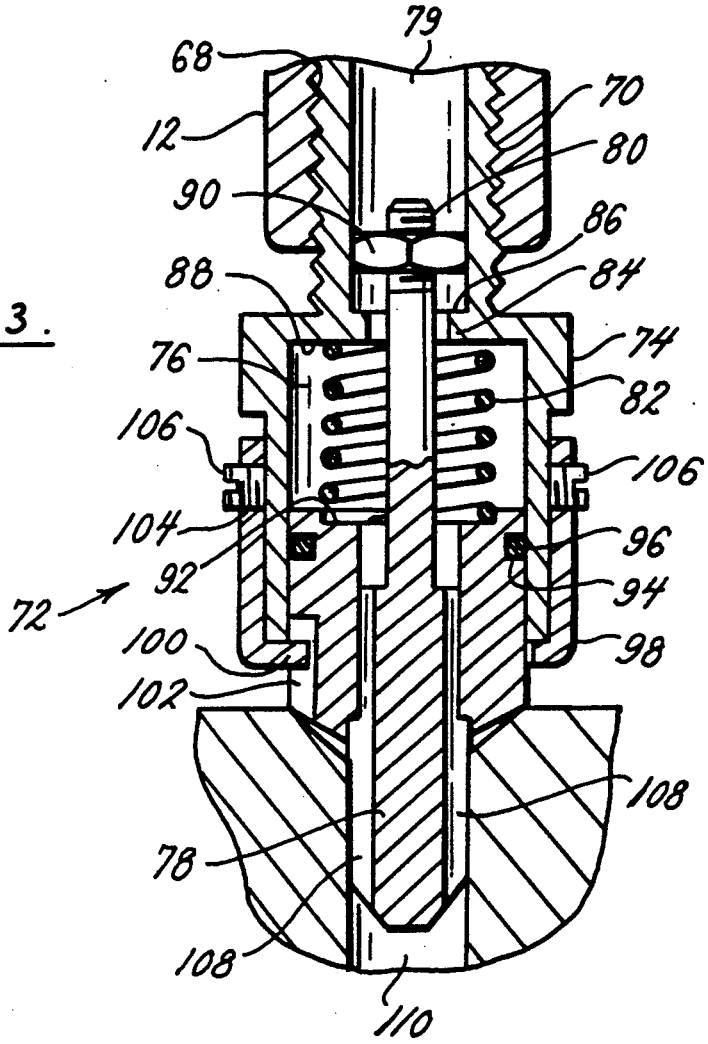
FIG. 3 is a cross-section of a nozzle engaging a countersunk rivet hole.

The adapter tube 12 has an internal thread 68 that receives the external thread 70 of an nozzle 72. The nozzle 72, see FIG. 3, comprises a housing 74 with the external thread 70 at one end, and a tip chamber 76 at the other end for receiving a tip 78. The external thread 70 has a bore 79 that is in fluid communication with the longitudinal channel 10. The tip 78 has a threaded shank 80 extending from one end and a spring 82 that fits around the shank 80. The applicator housing 74 has an inner lip 84 with a first 86 and second 88 face. The inner lip 84 has an inner diameter larger than the diameter of the shank 80, to allow fluid communication between the tip chamber 76 and the bore 79. A hexagonal nut 90 is contiguous to the first face 86 of the inner lip 84 and screws onto the shank 80 of the tip 78, securing the tip 78 to the applicator housing 74. The spring 82 rests between the second face 88 of the inner lip 84 and a recessed collar 92 in the tip 78. The tip 78 has an external groove 94 which retains a O ring 96, the O ring 96 provides a seal between the nozzle housing 74 and the tip 78.

Figure 4:
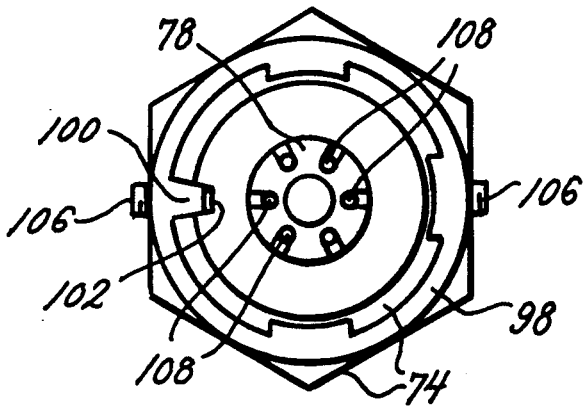
FIG. 4 is a top view of a nozzle.

Fitting over the applicator housing 74 is a locking collar 98 with a tongue 100, see FIG. 4. The tongue 100 rides along a groove 102 in the tip 78, guiding the tip 78 when the tip 78 is depressed. The tongue 100 and groove 102 prevent the tip 78 from rotating within the housing 74. The locking collar 98 has two threaded apertures 104 that receive two set screws 106. The set screws 106 engage the outside surface of the applicator housing 74 securing the collar 98 to the housing 74.

The tip 78 has a plurality of openings 108 that are in fluid communication with the tip chamber 76 of the applicator housing 74. When the nut 90 moves away from the inner lip 84, the tip chamber 76 becomes in fluid communication with the bore 79 and longitudinal channel 10, which are in fluid communication with the sealant cartridge 18.

To operate the rotating sealant applicator assembly 2, the automatic rivet machine 36 positions the assembly 2 above a fastener hole 110 and moves the assembly 2 down into the fastener hole 110, see FIG. 1. The downward movement of the assembly depresses the tip 78 into the housing 74, moving the nut 90 away from the inner lip 84, allowing sealant to flow into the tip chamber 76 through the openings 108 and onto the countersink of the fastener hole 110. The downward movement of the assembly 2 also pushes the adapter tube 12 further into the sleeve 4, causing the guide pin 64 to move along the slot 6, rotating the adapter tube 12 and nozzle 72. The rotation of the nozzle 72 causes the tip 78 to spread the sealant 20 around the countersink of the fastener hole 110. The rivet machine 36 then moves upward and the tip assembly spring 82 and adapter tube spring 60 return the tip 78 and adapter tube 12, respectively, to their original positions. The assembly 2 could be disengaged from the rivet machine 36 and sealant application could be performed by hand with the sealant assembly 2.

The amount of sealant 20 applied to a fastener hole 110, is a function of the displacement of the tip 78 within the housing 74. To change the amount of tip 78 displacement the tip 78 is screwed farther in or out of the nut 90. This is done by unscrewing the locking collar set screws 106, rotating the tip 78 and screwing the set screws 106 back onto the locking collar 98. The locking collar tongue 100 and tip groove 102 prevent the tip 78 from rotating within the housing 74 and changing the displacement, insuring that the same amount of sealant 20 is dispensed in each fastener hole 110 during an automated rivet cycle.

The nozzle 72 can be constructed with standard nozzles sold by Semco, Inc., by drilling a slot in the tip and adding the locking collar. The sealant applicator assembly 2 can be readily attached to a standard automatic rivet machine such as the machine sold by Gemcor, Inc.

While certain exemplary embodiments of this invention have been described above and shown in the accompanying drawings, it is to be understood that such embodiments are illustrated of, and not restrictive on, the broad invention. The invention is not to be limited by the specific instructions or arrangements shown and described, since various other modifications may occur to persons having ordinary skill in the art.

What is claimed is:

1. A sealant dispenser for discharging sealant into a fastener hole, comprising:
   (a) a sleeve having a first bore and an oblique slot;
   (b) a dispenser tube within said first bore having a longitudinal channel;
   (c) spring means operatively connected to said dispenser tube, for biasing said dispenser tube toward an outward position relative to said sleeve;
   (d) a guide pin attached to said dispenser tube, said guide pin extending into said oblique slot; and
   (e) a nozzle attached to said dispenser tube that dispenses the sealant, said nozzle having a plurality of openings in fluid communication with said longitudinal channel.

2. A sealant dispenser for dispenser for discharging sealant into a fastener hole, comprising:
   (a) a sleeve having a first bore and an oblique slot;
   (b) a dispenser tube within said first bore having a longitudinal channel;
   (c) first spring means operatively connected to said dispenser tube, for biasing said dispenser tube toward an outward position relative to said sleeve;
   (d) a guide pin attached to said dispenser tube and extending into said oblique slot;
   (e) a housing attached to said dispenser tube having a second bore at one end in fluid communication with said longitudinal channel, and a tip chamber in fluid communication with said second bore;
   (f) a tip operatively connected to and within said housing, and having an external longitudinal groove and a plurality of openings that dispense the sealant, said opening being in fluid communication with said tip chamber;

(g) second spring means operatively connected to said tip, for biasing said tip to an outward position relative to said housing;

(h) a locking collar detachably connected to said housing, said locking collar having a tongue that rides within said longitudinal groove.

3. The sealant dispenser as recited in claim 2 wherein said locking collar is detachably connected to said housing by at least one set screw.

4. The sealant dispenser as recited in claim 2 further comprising sealant cartridge means, detachably connected to said dispenser tube for providing a continuous supply of sealant to said dispenser tube.

* * * * *